US005203065A

United States Patent [19]

Peters

[11] Patent Number: 5,203,065

[45] Date of Patent: Apr. 20, 1993

[54] TOILET FIXTURE INSTALLATION APPARATUS

[76] Inventor: Morris P. Peters, 2525 Sage St., Santa Rosa, Calif. 95405

[21] Appl. No.: 807,718

[22] Filed: Dec. 16, 1991

[51] Int. Cl.[5] ..... B25B 27/14

[52] U.S. Cl. ..... 29/281.4; 29/281.1; 269/17; 254/2 R

[58] Field of Search ..... 4/661, 252.1, 9; 29/281.1, 281.4, 239; 269/17; 254/2 R, 93 R

[56] References Cited

U.S. PATENT DOCUMENTS 2,558,535 6/1951 Billings ..... 254/2 R 4,441,218 4/1984 Trybom ..... 4/252.1

*Primary Examiner*—P. W. Echols

*Assistant Examiner*—David P. Bryant

*Attorney, Agent, or Firm*—Larry D. Johnson

[57] ABSTRACT

A toilet fixture installation apparatus provides a compact structure for the support, movement, and alignment of toilet bowl fixtures during their installation. The inventive apparatus includes a three-wheeled base structure having a pair of lower frame members connected by a crossmember and defining a base plane, a fixed vertical mast portion carrying a sliding mast elevated by a jack member, a fixed horizontal boom extending from the sliding mast in the direction of the lower frame members, a fixed shoe assembly at the end of the fixed horizontal boom and bearing an outwardly-extending toilet bowl gripping member, an adjustable shoe slidably mounted and selectively fixed on the fixed horizontal boom bearing a toilet bowl gripping member extending in the opposite direction from the fixed shoe toilet bowl gripping member, this adjustable shoe also being vertically adjustable relative to the fixed shoe.

2 Claims, 2 Drawing Sheets

TOILET FIXTURE INSTALLATION APPARATUS

BACKGROUND OF THE INVENTION

1. Field of the Invention

This invention relates generally to tools and installation hardware, and more specifically to an improved apparatus for installation of toilet fixtures.

2. Description of the Prior Art

The installation of common toilet bowl fixtures is an awkward and time-consuming task. Accordingly, numerous devices have been developed to assist the installer. However, most known devices are themselves bulky, difficult to move, and do not enable the fine positioning adjustment desirable during installation.

SUMMARY OF THE INVENTION

The toilet fixture installation apparatus of this invention provides a relatively compact structure for the support, movement, and alignment of toilet bowl fixtures during their installation. The inventive apparatus includes a three-wheeled base structure having a pair of lower frame members connected by a crossmember and defining a base plane, a fixed vertical mast portion carrying a sliding mast elevated by a jack member, a fixed horizontal boom extending from the sliding mast in the direction of the lower frame members, a fixed shoe assembly at the end of the fixed horizontal boom, and bearing an outwardly-extending toilet bowl gripping member, an adjustable shoe slidably mounted and selectively fixed on the fixed horizontal boom, bearing a toilet bowl gripping member extending in the opposite direction from the fixed shoe toilet bowl gripping member, this adjustable shoe also being vertically adjustable relative to the fixed shoe.

DETAILED DESCRIPTION OF A PREFERRED EMBODIMENT

Figure 1:
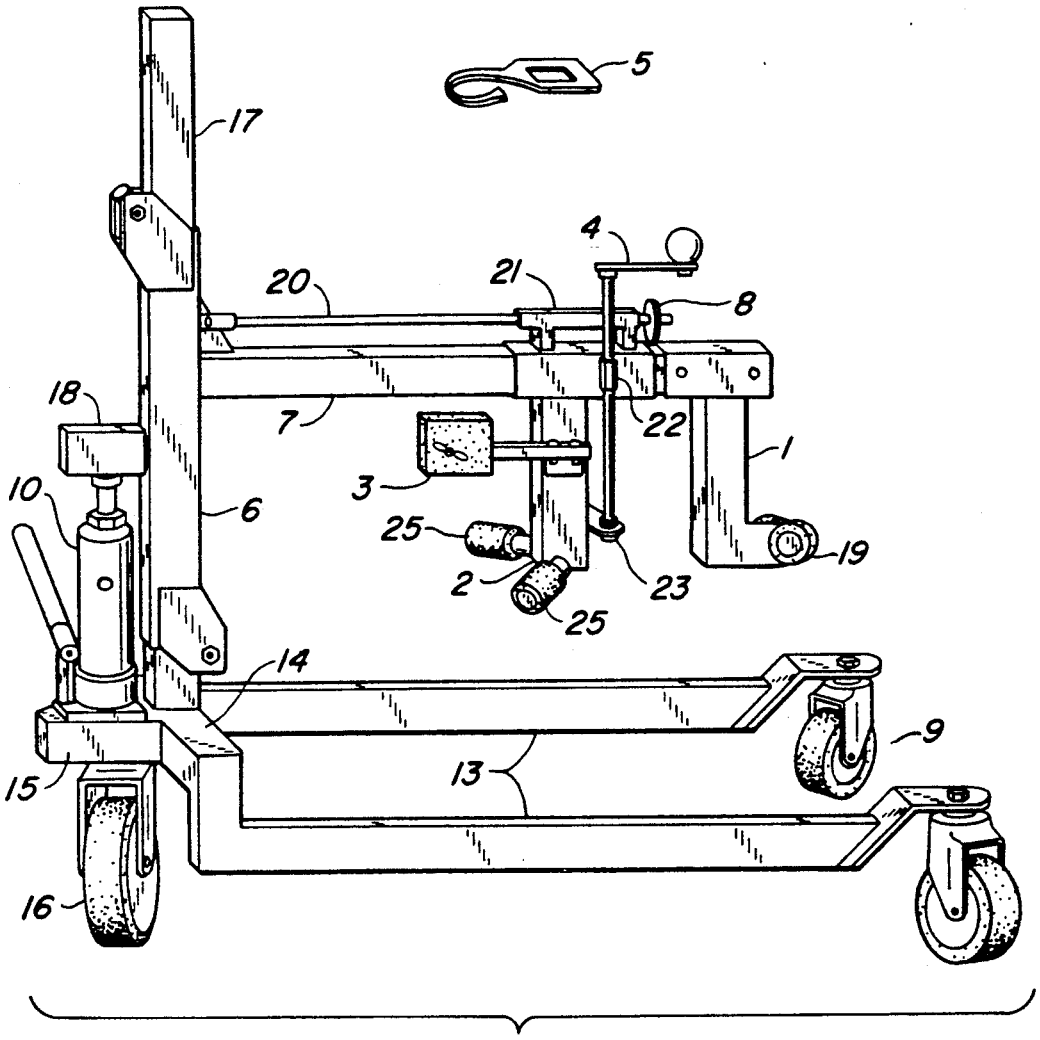
FIG. 1 is a perspective view of the toilet fixture installation apparatus of this invention, illustrating the apparatus in its erected configuration for use.

FIG. 1 is a perspective view of the toilet fixture installation apparatus of this invention, illustrating the apparatus in its erected configuration for use. The apparatus comprises a pair of twenty-four inch long lower frame members 13 connected at one end by a twenty inch long crossmember 14. At the opposite end of each of these frames 13 is a four inch diameter castering wheel 9. Located at the center of the outer side of the crossmember 14 is a small trapezoidal shaped extension 15. On the lower side of this extension is a third five inch diameter castering wheel 16. On its upper surface is a hydraulic bottle jack 10. Extending upwards from the center of the crossmember 14 is a twenty-four inch high mast 17. Slidably mounted on this mast is a fourteen inch sliding mast 6. On the rear side of this sliding mast is a short extension 18 that engages with the ram end of the back 10. Extending from the opposite side of the sliding mast is an eighteen inch long horizontal boom 7. At the free end of this boom is a fixed shoe assembly 1, the lower ends of which are equipped with a pair of outwardly-extending short curved rubber clad gripping fingers 19. Slidably mounted on the horizontal boom 7 is an adjustable shoe 2, equipped with a similar pair of fingers 25 extending in the opposite direction from fingers 19. The horizontal position of this adjustable shoe is regulated by way of a threaded rod 20, which is attached on on end to the sliding mast 6 and extending through a small sleeve 21, which is fixed on the upper surface of adjustable shoe 2. On the end of the threaded rod 20 is a small knurled adjusting nut 8. The lower portion of adjustable shoe 2 is vertically slidably mounted, and controlled by a vertical threaded rod and leveling crank 4. The rod is threaded through block 22, which is fixed on the side of the horizontal sliding portion of adjustable shoe 2 and terminates on the vertically sliding portion of the finger assembly by a thrust collar 23. A separate retainer stop 5 slides move mast 17 and is used to anchor the sliding mast 6 so the installer can easily carry the entire unit with one hand by grasping the boom 7 just forward of mast 6. This retainer stop is only used for carrying purposes.

To use the apparatus the installer would lower the horizontal boom 7 so that its front finger assembly 19 would extend inside the toilet bowl to be raised. Then the installer would move the unit forward until the fingers 19 are seated under the rear rim of the toilet bowl. The installer would then slide the rear adjustable shoe 2 horizontally in a position so that the fingers 25 of ajustable shoe 2 reach the underside of the front toilet rim. Then using the leveling crank 4 as necessary, and positioning the upthrust block 3 to fit snugly on top of the toilet rim, the installer would then retain this position with nut 8. The jack 10 would then be used to raise the entire toilet up clear of the floor. The upthrust block 3 is provided to secure adequately the grip on the toilet bowl. It is made of nylon or a similar strong, no-mar material. It is rectangular and mounted on an extension arm to contact the top rim of the toilet bowl and retained with a single bolt and wing-nut. It provides different spacings relative to the fingers 25 of adjustable shoe 2, thus accommodating different bowl configurations.

In setting the toilet bowl over the flange and wa ring, the reverse sequence of installation would be used, as well as the leveling crank 4 to adjust the horizontal plane of the toilet base so that it contacts the ring and flange squarely. An additional feature that greatly facilitates easy alignment of the hold down bolts is the adequate size of the castering wheels 9 and 16.

The adjustability of shoe 2 provides several advantages. First, the device conforms to all toilet bowls without changing blocks or fingers. Also, this enables the device to adjust vertically to change the plane of the toilet base to conform with the floor flange. Furthermore, when the closet flange is plumbed too close to the wall and the toilet tank actually rests against the back wall, the installer can use the adjustable shoe to tip the toilet slightly forward out of level to enable alignment of the floor bolts, and then proceed with the lowering operation.

Figure 2:
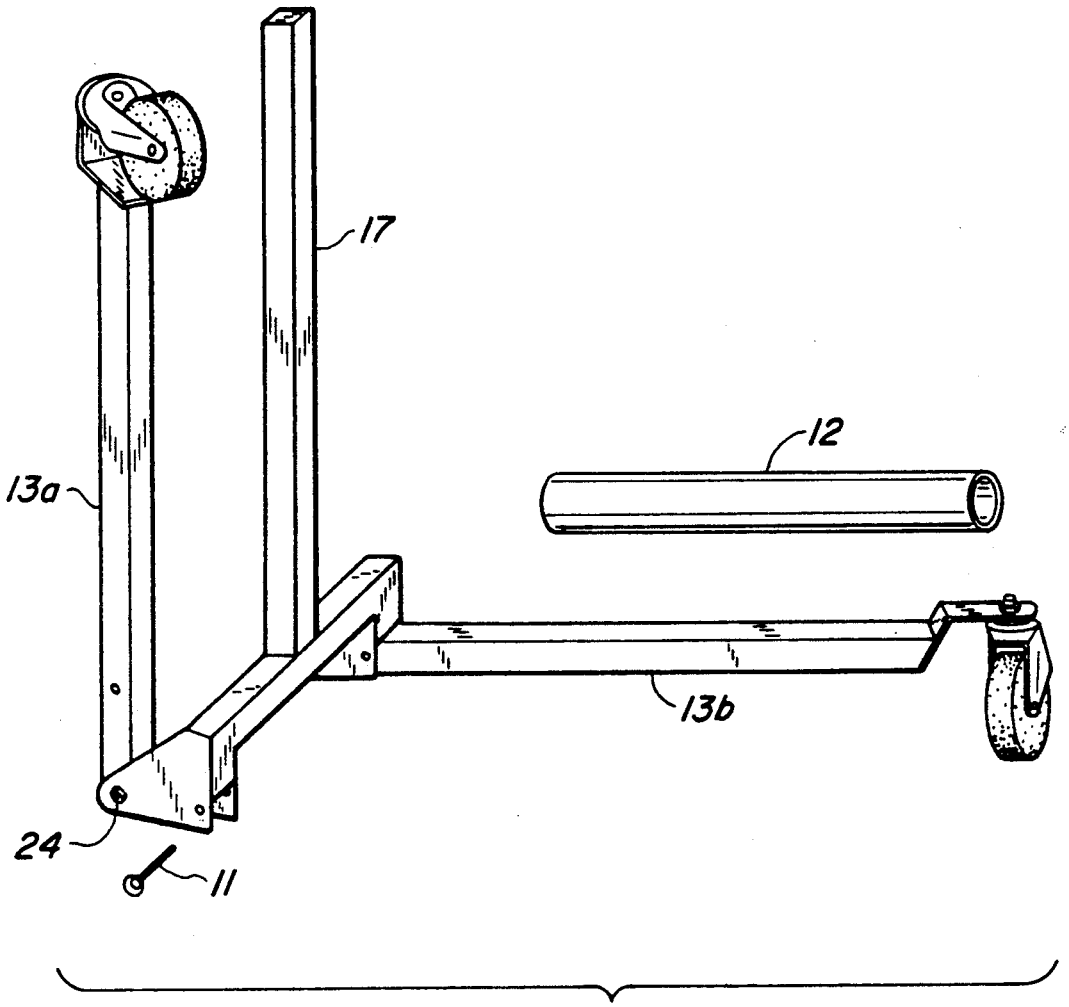
FIG. 2 is a perspective view of an alternate embodiment of the toilet fixture installation apparatus of this invention, illustrating a pivotable lower frame member enabling collapsing of the structure, and a guard portion to protect the toilet fixture during installation.

FIG. 2 is a perspective view of an alternate embodiment of the toilet fixture installation apparatus of this invention, illustrating a pivotable lower frame member enabling collapsing of the structure, and a guard portion to protect the toilet fixture during installation. The collapsible model enables compact shipping, storing, transporting, etc. To collapse this unit, the installer would lift the sliding mast 6 clear of the unit and place it in the bottom of the carry box provided. Next the installer would remove two retainer pins 11, one at a time, and swing the lower frame members 13*a*, 13*b* under and up in line with the mast 17, pivoting on a bolt and bushing 24. This creates a shallow structure which is then placed on top of the mast and boom assembly already in the box.

Also illustrated in FIG. 2 is a protective guard 12 for the lower frame members 13 of both models. It is made of polyurethane or similar material to eliminate damage to the toilet base, should the lower frame members contact it during initial positioning.

While this invention has been described in connection with preferred embodiments thereof, it is obvious that modifications and changes therein may be made by those skilled in the art to which it pertains without departing from the spirit and scope of the invention. Accordingly, the scope of this invention is to be limited only by the appended claims.

What is claimed as invention is:

1. A toilet fixture installation apparatus for the support, movement, and alignment of a toilet bowl fixture during its installation, said toilet bowl fixture having a front rim and a rear rim, said toilet fixture installation apparatus comprising:

a three-wheeled base structure having a pair of generally parallel lower frame members connected by a crossmember and defining a base plane;

a fixed vertical mast portion perpendicular to and connected to the center of said crossmember and carrying a sliding mast elevated by a jack member;

a fixed horizontal boom portion having an end extending perpendicularly from said sliding mast in the direction of said lower frame members;

an L-shaped fixed shoe assembly beneath and at said end of said fixed horizontal boom, said fixed shoe assembly bearing an outwardly-extending toilet bowl rear rim gripping member comprising curved gripping fingers;

an L-shaped adjustable shoe assembly slidably mounted on and selectively fixed beneath said fixed horizontal boom between said sliding mast and said fixed shoe assembly, said adjustable shoe assembly bearing a toilet bowl front rim gripping member comprising curved gripping fingers extending in the opposite direction from said fixed shoe assembly toilet bowl gripping member, said adjustable relative to said fixed shoe assembly to adjust the horizontal plane of said toilet bowl fixture.

2. The toilet fixture installation apparatus of claim 1 wherein said adjustable shoe assembly includes an adjustable block portion adjacent to and opposed from said front rim gripping member gripping fingers to releasably capture said toilet bowl fixture front rim.

* * * * *